United States Patent [19]

Howie

[11] 4,203,252

[45] May 20, 1980

[54] SOUND ADMITTING AERIAL TOY

[76] Inventor: Wilbert A. Howie, 602 Thetis Place, Richmond, British Columbia, V7C 2N3

[21] Appl. No.: 909,291

[22] Filed: May 24, 1978

[51] Int. Cl.[2] ..... A63H 5/00

[52] U.S. Cl. ..... 46/178; 46/52; D21/100

[58] Field of Search ..... 46/178, 179, 180, 52, 46/66, 47-63; 272/124; 84/477 B; 273/95 R; D21/92, 93, 100

[56] References Cited

U.S. PATENT DOCUMENTS

| | | | |
|---|---|---|---|
| 1,113,162 | 10/1914 | Murphy | 46/179 |
| 2,968,890 | 1/1961 | De Nisco | 46/179 |
| 3,006,646 | 10/1961 | Nanni | 272/124 |
| 3,216,727 | 11/1965 | Hunter | D21/100 |
| 3,354,770 | 11/1967 | Haug | 84/477 B |
| 3,637,205 | 1/1972 | Bankston | 84/477 B |
| 4,030,761 | 6/1977 | Daller | 46/178 |

*Primary Examiner*—Russell R. Kinsey
*Assistant Examiner*—Michael J. Foycik, Jr.
*Attorney, Agent, or Firm*—Fulwider, Patton, Rieber, Lee & Utecht

[57] ABSTRACT

A toy has an elongate body dimensioned to be held in the hand. A whistle or reed responsive to the passing of air to produce a sound is positioned at at least one end of the elongate body. Throwing the body through the air produces a sound.

13 Claims, 5 Drawing Figures

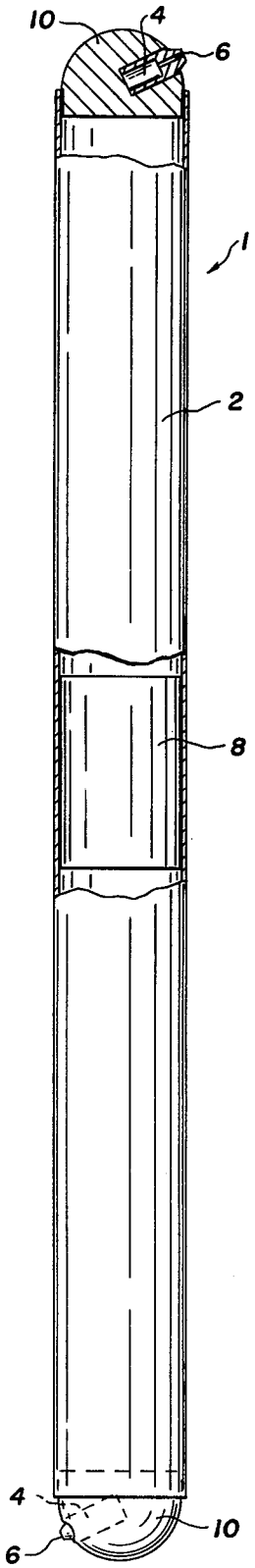
Fig. 1.
Fig. 2.
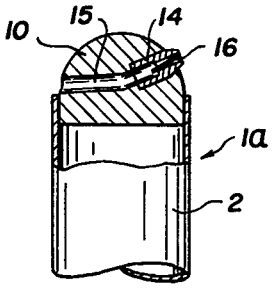

SOUND ADMITTING AERIAL TOY

This invention relates to a toy.

The present invention seeks to provide a toy that can be thrown through the air and emits a sound as it passes through the air. In a particular embodiment the toy can be thrown upwardly with a somersaulting or cartwheeling action to emit a continuous sound.

Accordingly, in a first aspect, the invention provides a toy comprising an elongate body dimensioned to be held in the hand, means responsive to the passing of air to produce a sound positioned at at least one end of the elongate body whereby throwing the body through the air produces the sound.

Several embodiments of this invention are illustrated, by way of example, in the accompanying drawings, in which:

FIG. 1 is a view, partially in section of a preferred embodiment of a toy according to the invention;

FIG. 2 is a fragmentary view of a variation of the toy of FIG. 1,

Figure 3:
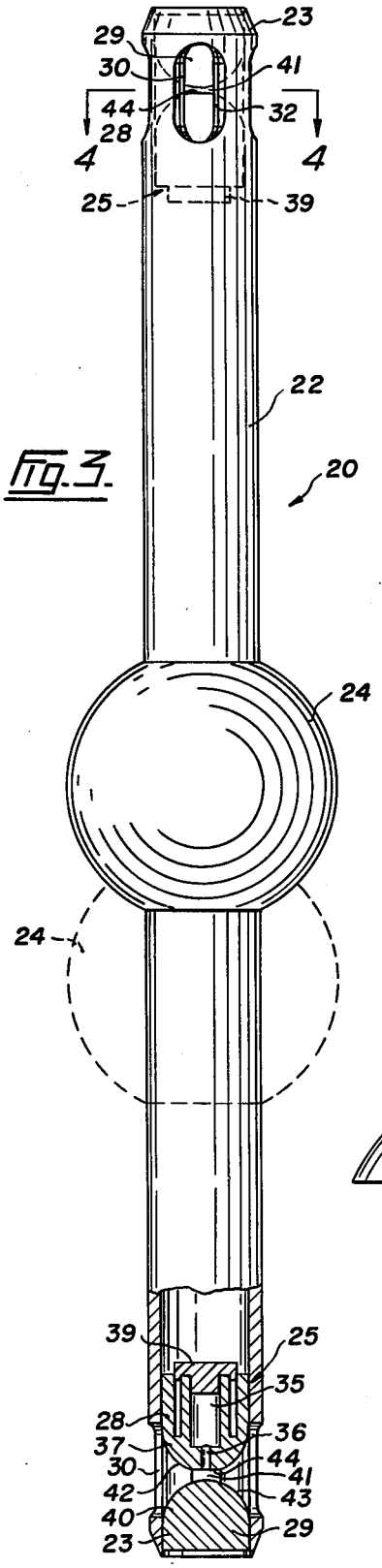
FIG. 3 illustrates an alternative form of toy according to the invention.

Referring to the drawings, FIG. 1 illustrates a toy 1 comprising an elongate body 2 which is dimensioned in length and in diameter to be a comfortable grip for the hand. Body 2 has a noise maker at each end thereof in the form of a passageway or chamber 4 including a restricted opening 6 opening outwardly from the body. Each passageway or chamber is such that as the toy is thrown in the air, air passing across an opening 6 of the chamber 4 vibrates the column of air within said chamber. In the illustrated embodiment there are sound producing means in the form of passageways or chambers 4 formed at each end of the body. It is practical to produce a toy with a chamber in one end only thereof. However, the illustrated embodiment is preferred.

The body 2 is provided with a balance weight 8 at about its center of balance. This facilitates the cartwheeling action of the toy when it is thrown upwardly in the air and given a rotating motion.

In the illustrated embodiment of FIG. 1, toy 1 is formed of four pieces. The elongate body 2 has a balance weight 8 at the center. At the ends there are domes 10 in which the passageway or chambers 4 are formed. The inlets 6 in the passageway may be formed, for example, by metal inserts.

Toy 1 may be made of a plastic material completely. Alternatively, the body 2 may be of rubber or plastic and the dome 10 may be of wood, rubber or a plastic such as nylon. Desirably, the weight 8 is of metal and positively mounted. Alternatively the balancing weight may be designed to be movable to a variety of positions to change the center of balance.

The toy 1 can be produced by locating the weight 8 at the center of balance of the body 2 and locating it there, for example, by glue. Alternatively the weight 8 may simply be forced into position and be retained in its position by frictional contact. The domes 10, with their preformed channels 4 are then adhered at the ends of the body 2, for example by glue or some equally well known means of attachment.

The openings 6 for the passageways 4 are desirably on opposed sides of the body 2 as illustrated in the drawing. The weight 8 may be positioned on the exterior of the body 2.

FIG. 2 illustrates a toy 1*a* which is a variation of the toy shown in FIG. 1. Toy 1*a* includes an alternative form of noise maker 14 in dome 10. This noise maker includes a passageway or chamber 15 extending through the dome and opening out at opposite ends from the latter. A reed 16 is located in this passageway or chamber near one end thereof so that air moving through the passageway or chamber causes the reed to vibrate and thereby make a noise. This toy has a noise maker 14 at one or both ends of the body 2.

The toys of FIGS. 1 and 2 provide amusement in the same manner. On throwing the toy upwardly it will somersault or cartwheel rapidly due to the weight placed at the center of balance. This rapid rotation causes air to pass by the sound-producing means and produce a sound. The weighting enables the user a generous amount of control and will allow one or more people to handle one or two or more units at one time. By having this weight movable the handler can vary the rotating action of the toy.

Figure 4:
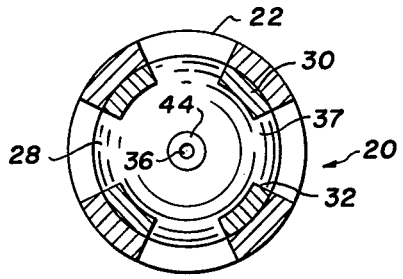
FIG. 4 is an enlarged section taken on the line 4—4 of FIG. 3.

FIGS. 3 and 4 illustrate an alternative toy 20 having an elongate body 22 with a noise maker 23 at one or both ends thereof, two of these noise makers being shown in FIG. 3. Body 22 may be in the form of a tube formed of plastic or other suitable material. A weight in the form of a rubber ball 24 is mounted on the body 22 centrally thereof. This weight can be fixed to the body, or it can be made to adhere thereto by friction so that it can be shifted longitudinally of the body, if desired.

Each noise maker 23 can be integrally formed with the adjacent end of body 22, but it is preferably in the form of an insert or head 25, as shown. In this example, the head 25 is in the form of a first section 28 and a second section 29 interconnected by circumferentially spaced bars 30, the spacing of these bars forming openings 32 therebetween. The first section 28 is formed with a central passageway or chamber 35 extending longitudinally thereof. A restricted opening or passage 36 opens out through the inner end 37 of section 28 centrally of said end. The passageway or chamber 35 is in communication with the surrounding air through opening 36. A cap 39 fits on the outer end of section 28 to close the adjacent end of chamber 35.

The section 29 has an inner end 40 facing but spaced from the inner end 37 of section 28. The ends 37 and 40 are preferably dome-shaped as shown so as to form a restricted channel 41 therebetween, this channel expanding radially outwardly as indicated at 42 and 43. This restricted channel 41 extends across the opening 36 of the inner end of section 28, said opening 36 being located in a flat area 44 at the centre of this inner end.

When toy 20 is assembled, an insert or head 25 is attached at one end or each of the ends of body 22. In this example, the first section 28 at the inner end of the head is pressed into the adjacent end of the tubular body 22, said second end 29 being spaced outwardly from the body at this time. The head can be removable from the body, or it can be fixedly secured thereto by glue or the like. When toy 20 is thrown upwardly in the air, it is subjected to a cartwheeling action in the same manner as toy 1 described above. The rapid rotation of the toy causes air to flow through channel 41 and across the end of the restricted opening 36 to cause vibration of the air within passageway or chamber 35, thereby creating a noise. The restricted channel 41 acts as a venturi so that the velocity of the air is increased as it moves across opening 36 thereby increasing the amount of noise made as the toy rotates through the air.

Figure 5:
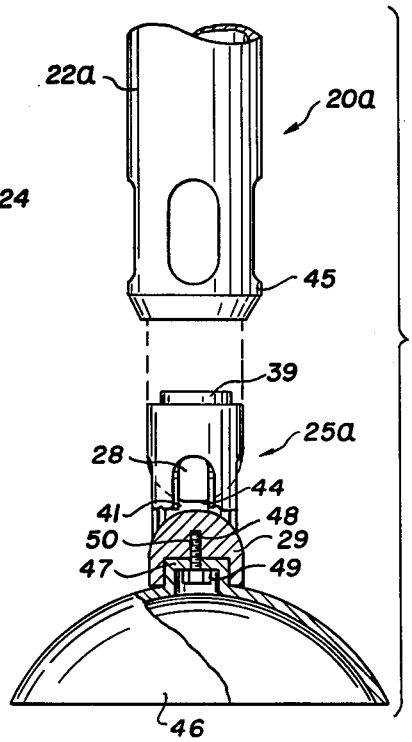
FIG. 5 is an exploded fragmentary view of a variation of the toy of FIG. 3.

FIG. 5 illustrates a toy 20*a* which is a variation of toy 20 of FIGS. 3 and 4. Toy 20*a* has a head 25*a* that is essentially the same as head 25 and a body 22*a* the same as body 20 and having an end 45. Head 25*a* fits inside body 20*a* through end 45 and carries a suction cup 46. Suction cup 46 is provided with a base 47 having an outer end which bears against the outer end of head section 29. A bolt 48 having a head 49 embedded in base 47 projects from said base centrally thereof and is threaded into a socket 50 formed in the head section 29.

Toy 20*a* functions in the same manner as toy 20 and can stick to a smooth surface by the action of the cup 46. The noise is created as the air passes through the restricted channel 41 of the head and over the restricted opening 36 thereof.

Instead of bolt 48 the suction cup 46 could be attached to the toy by an adhesive or by mutually engaging members such as available under the trade mark Velcro.

I claim:

1. A toy comprising an elongate body dimensioned to be held in the hand, means responsive to the passing of air to produce a sound, said means comprising a chamber having a restricted passageway opening outwardly from the toy, said means being positioned at each end of the elongate body whereby throwing the body through the air produces the sound, and a weight at the center of balance of the body to facilitate cartwheeling of the body when the toy is thrown upwardly.

2. A toy as claimed in claim 1, in which the means responsive to the passing of air to produce the sound is a reed.

3. A toy as claimed in claim 1, in which the means responsive to the passing of air to produce the sound is a passageway formed in the elongate body.

4. A toy as claimed in claim 1, comprising a hollow elongate body of circular cross section;

a dome formed at each end of the body;

an inlet in each dome; and weighting substantially at the centre of balance of the body whereby when the toy is thrown upwardly with a cartwheeling motion it produces a sound by air passing across the inlets.

5. A toy as claimed in claim 4, in which the weight is within the body.

6. A toy as claimed in claim 4, in which the weight is movable.

7. A toy comprising an elongate body, a noise maker at at least one end of the body, said noise maker comprising a chamber having a restricted passageway opening outwardly from the noise maker, and a weight at the center of balance of the body to facilitate cartwheeling of the toy when the toy is thrown upwardly;

whereby when the toy is thrown upwardly with a cartwheeling motion, sound is produced by air passing over said passageway.

8. A toy as claimed in claim 7 having a noise maker at both ends of the body and in which each noise maker comprises a head on an end of the body, said head including two aligned sections spaced apart to form a restricted channel therebetween, and interconnecting means between said aligned sections, said chamber being formed in one of said sections, and said restricted passageway opening into said restricted channel, whereby air travelling through the channel passes over said passageway to produce the sound.

9. A toy as claimed in claim 8 in which each noise maker head is removably mounted on an end of said body.

10. A toy as claimed in claim 8 in which there is a suction cup attached to at least one end of the toy.

11. A toy as claimed in claim 8 in which adjacent ends of the two aligned sections are rounded.

12. A toy as claimed in claim 8 in which said interconnecting means comprises a plurality of bars extending between the sections, said bars being circumferentially spaced to provide openings therebetween.

13. A toy comprising an elongate body;

a noise maker at both ends of the body, each noise maker comprising a head on an end of the body and including a chamber having a restricted passageway opening outwardly from the noise maker, said head including two aligned sections spaced apart to form a restricted channel therebetween, a plurality of bars extending between the sections, said bars being circumferentially spaced to provide openings therebetween;

said chamber being formed in one of said sections and said restricted passageway opening into said restricted channel, whereby air travelling through the channel passes over said passageway to produce the required sound.

* * * * *